United States Patent [19]

Glessner

[11] 4,146,266

[45] Mar. 27, 1979

[54] ADJUSTABLE WEAVER'S BENCH

[76] Inventor: James S. Glessner, R.D. 2, Somerset, Pa. 15501

[21] Appl. No.: 893,755

[22] Filed: Apr. 5, 1978

[51] Int. Cl.[2] ..... A47C 7/62; A47C 15/00

[52] U.S. Cl. ..... 297/192; 108/4; 108/144; 297/338; 297/345

[58] Field of Search ..... 297/192, 188, 437, 313, 297/338, 345; 108/4, 5, 25, 137, 143, 146, 144; 182/202

[56] References Cited

U.S. PATENT DOCUMENTS

| | | | |
|---|---|---|---|
| 1,104,675 | 7/1914 | Kilberg et al. | 108/4 |
| 1,515,760 | 11/1924 | Small | 297/192 X |
| 2,673,774 | 3/1954 | Di Prima | 108/25 X |
| 2,685,095 | 8/1954 | Carlson | 108/4 |
| 2,768,043 | 10/1956 | Kristoff et al. | 108/137 X |
| 3,173,512 | 3/1965 | Sturdy et al. | 182/202 |
| 3,908,560 | 9/1975 | Horner | 108/4 X |

FOREIGN PATENT DOCUMENTS

| | | | |
|---|---|---|---|
| 797949 | 2/1936 | France | 108/25 |
| 615680 | 1/1961 | Italy | 108/137 |

*Primary Examiner*—James T. McCall

*Attorney, Agent, or Firm*—Brown, Flick & Peckham

[57] ABSTRACT

An adjustable wooden bench has four legs, the upper portions of which are connected by a pair of horizontal rails provided with vertical openings through which the legs extend. The rails support a seat that is slidable lengthwise of them. A horizontal footrest rail like the top rails is mounted on the lower portions of the front legs. The top front rail is supported by a pair of flexible cables anchored at one end to the front legs above the rail, with the cable extending down through the rail and then lengthwise of the rail in opposite directions in engagement with its bottom and then down to anchors on the other front legs. Normally, the cables are locked against movement lengthwise of the rail to prevent it from moving vertically. The back rail and the footrest may be supported by cables in the same way as the front rails.

8 Claims, 5 Drawing Figures

ADJUSTABLE WEAVER'S BENCH

It is among the objects of this invention to provide a wooden bench which has a seat resting on a pair of rails, which permits the elevation and angle of the seat to be adjusted, and in which at least one of the rails is readily adjustable vertically and is maintained horizontal during such adjustment.

The preferred embodiment of the invention is illustrated in the accompanying drawings, in which FIG. 1 is a front view of the bench;

Figure 1:
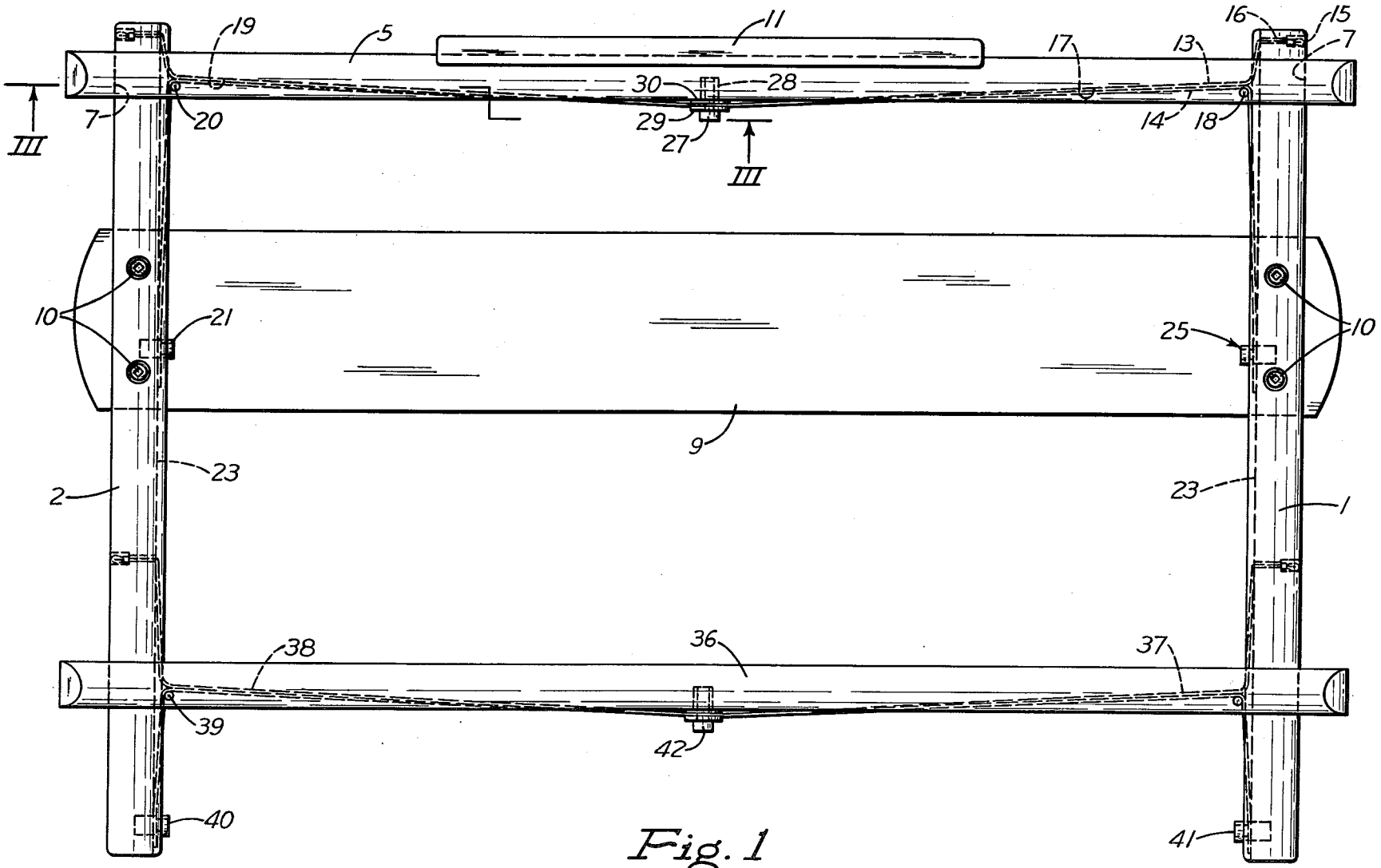

Referring to the drawings, the wooden bench is provided with two post-like front legs 1 and 2 and two back legs 3 and 4, all of which are identical and the same size from top to bottom. The upper portions of the front legs are connected by a top rail 5, and the back legs are connected by a like rail 6 parallel to the front rail. Each of these rails has a circular vertical opening 7 through each end, through which extend the legs on which the rails are in sliding engagement. The manner in which the rails are supported on the legs will be explained presently.

The four legs are rigidly connected by means of a rectangular tray 9 that is located between them some distance below their upper ends. The tray has a bottom wall and upwardly extending parallel side walls and parallel end walls. The legs are attached to the tray by vertically spaced screws 10 extending through the legs and the adjoining sides of the tray and into its end walls. The two rails support a seat 11 that is considerably shorter than the rails. The seat merely rests on the rails so that it can be slid lengthwise of the bench to any desired position.

It is a feature of this invention that the top rails can be adjusted vertically on the legs independently of each other to vary the height of the seat and also its angle if desired. Accordingly, the front rail is supported by a pair of wire lines or small cables 13 and 14. Each cable is attached to the upper end of one of the front legs and then extends down through the front rail and lengthwise beneath it and then down to an anchor point on the opposite leg.

Figure 5:
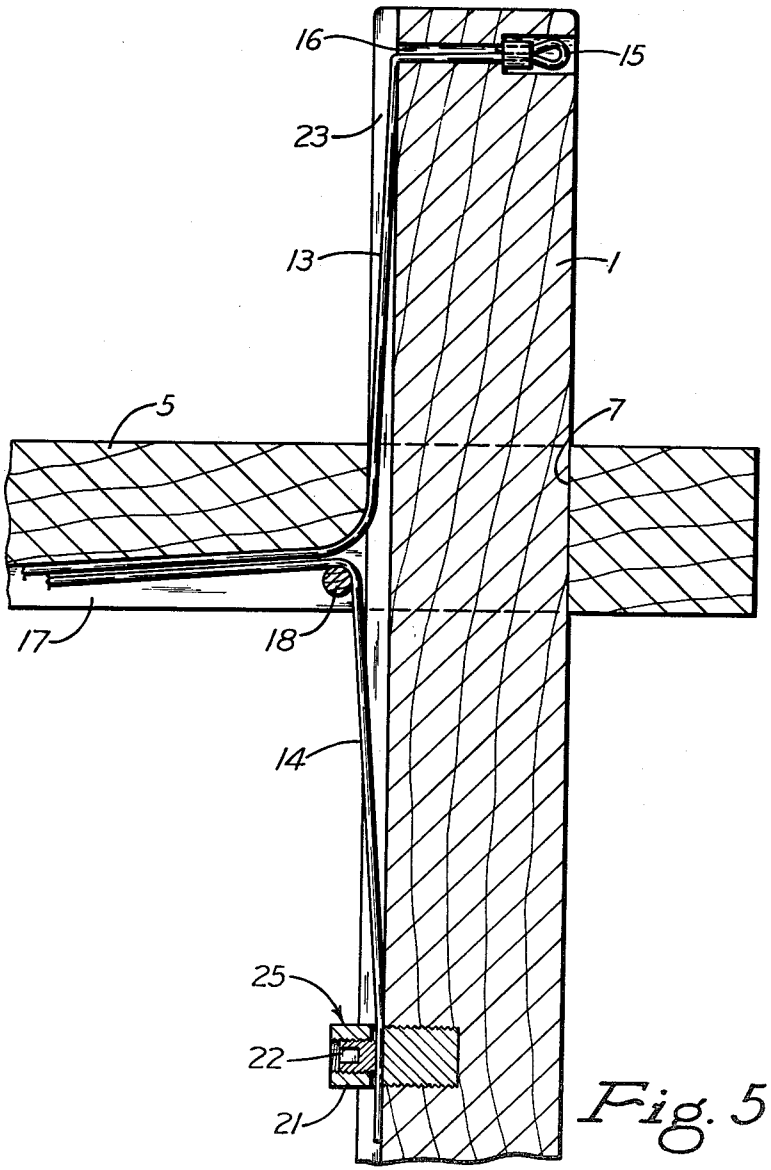
FIG. 5 is an enlarged fragmentary vertical section through one of the front legs and the front rail.

Thus, as shown in FIGS. 1 and 5, cable 13 is provided at its upper end with a loop 15 or other means of enlarging it, which is disposed in the enlarged outer end of a bore 16 through the front leg 1. From the inner end of this bore the cable extends down through the underlying opening 7 in that end of the rail. The bottom of the rail preferably is provided with a slot 17 extending toward the opposite end of the rail, but fading out at the center of the rail. A supporting member, such as a dowel pin 18, extends transversely through the rail and across the slot close to leg 1. The cable preferably extends above this pin and along slot 17 and then along a similar slot 19 in the bottom of the rail. The outer end of this slot, next to leg 2, also is crossed by a pin 20, over which the cable extends and then down along the leg to an anchor below the top of the tray. The lower end of the cable can be anchored to the leg by means of a threaded member 21 screwed into the leg and provided with a vertical passage, through which the cable extends. The outer end portion of this member is threaded internally and contains a plug 22 that is screwed in to clamp the cable in place. See the details of such an anchor mounted in leg 1 in FIG. 5. The legs are provided with vertical grooves 23 that received the vertical portions of the cable.

The other cable 14 extends from leg 2 down through the underlying opening in the rail, above cross pin 20 and lengthwise of the rail through slots 19 and 17 and then over the other cross pin 18 and down to an anchor 25 in the other leg. The rail is supported by these two cables, which extend in opposite directions along its bottom.

With this system of cables, the front rail can be moved up and down the legs easily because the cables will keep the rail from tilting lengthwise. Since they maintain the rail horizontal and at right angles to the front legs, it is not necessary to adjust one end or the other of the rail to level it after it has been moved vertically on the legs.

Figure 3:
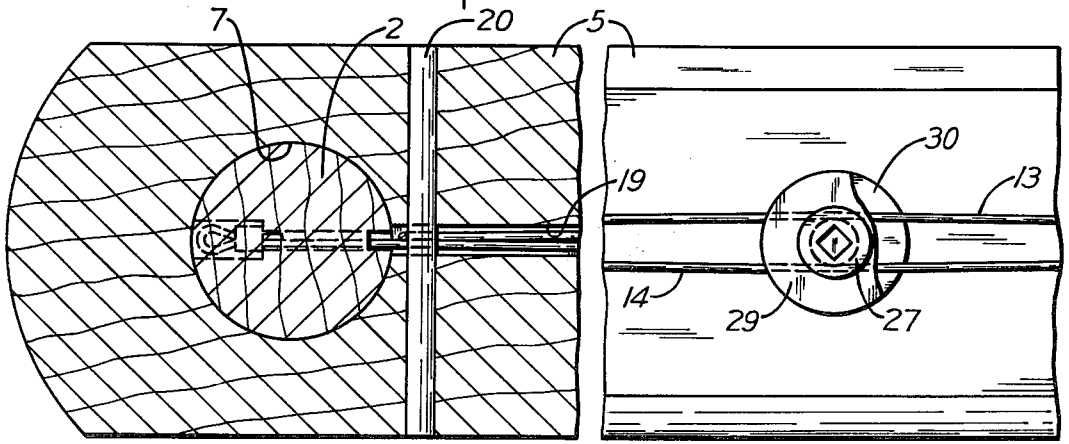
FIG. 3 is an enlarged fragmentary horizontal section taken on the line III—III of FIG. 1.

While the bench is in use, of course, the front rail must not slide down the legs. To prevent that from occurring, means are provided for locking the cables so that they cannot move relative to it. If they cannot move, the rail cannot move vertically. A preferred way of locking the cables against movement is to clamp them against the bottom of the rail by means of a screw 27 that is screwed up into a metal insert 28 plugged into a hole in the rail, preferably midway between its ends as shown in FIGS. 1 and 3. This screw extends between the two cables and presses a washer 29 against them. Although the washer could press the cables directly against the rail, to avoid any tendency of them to slip on the rail, it is preferred that a resilient washer 30 made of rubber or the like be interposed between the cables and the rail.

Figure 2:
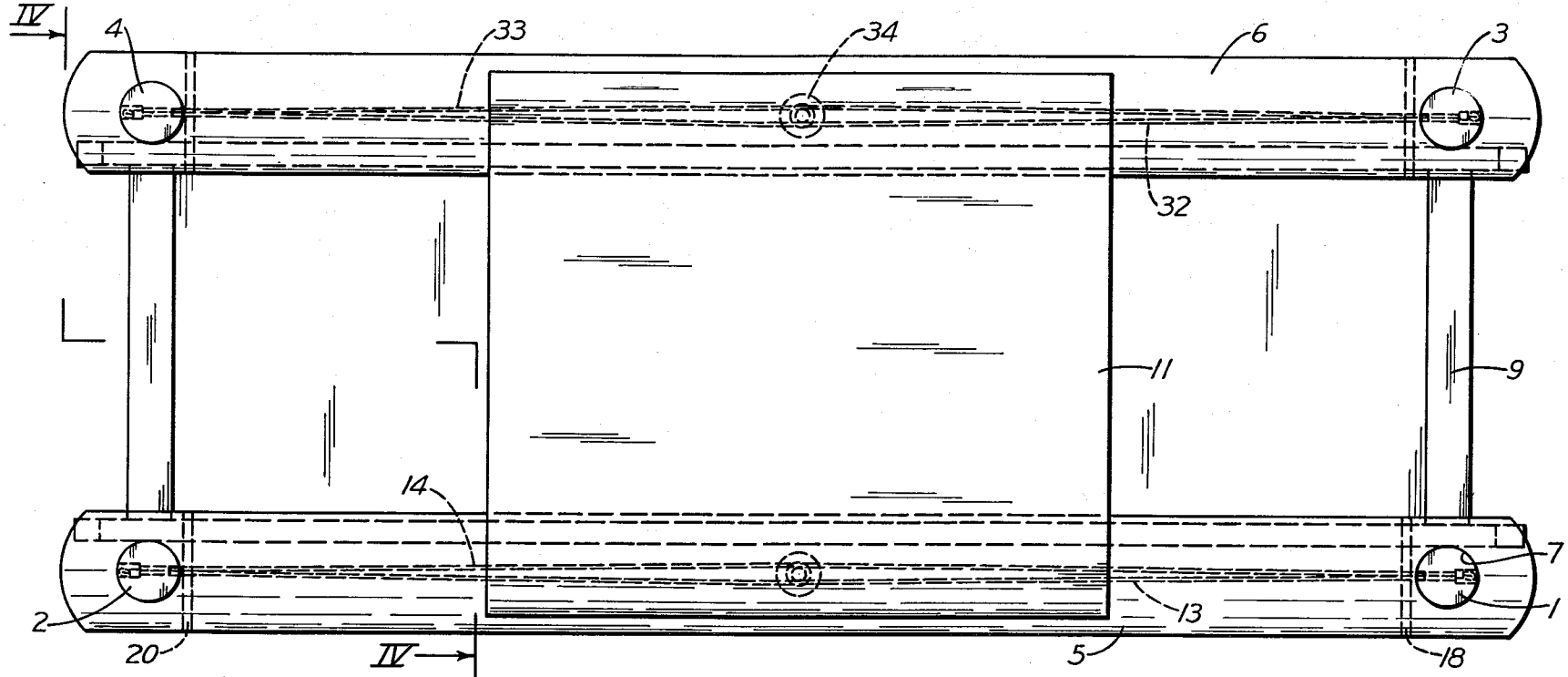
FIG. 2 is a plan view.

The back rail 6 is supported by two cables 32 and 33 in the same way as the front rail, and normally is supported by them in fixed position, due to their being held motionless by a clamp 34 as shown in FIG. 2.

Figure 4:
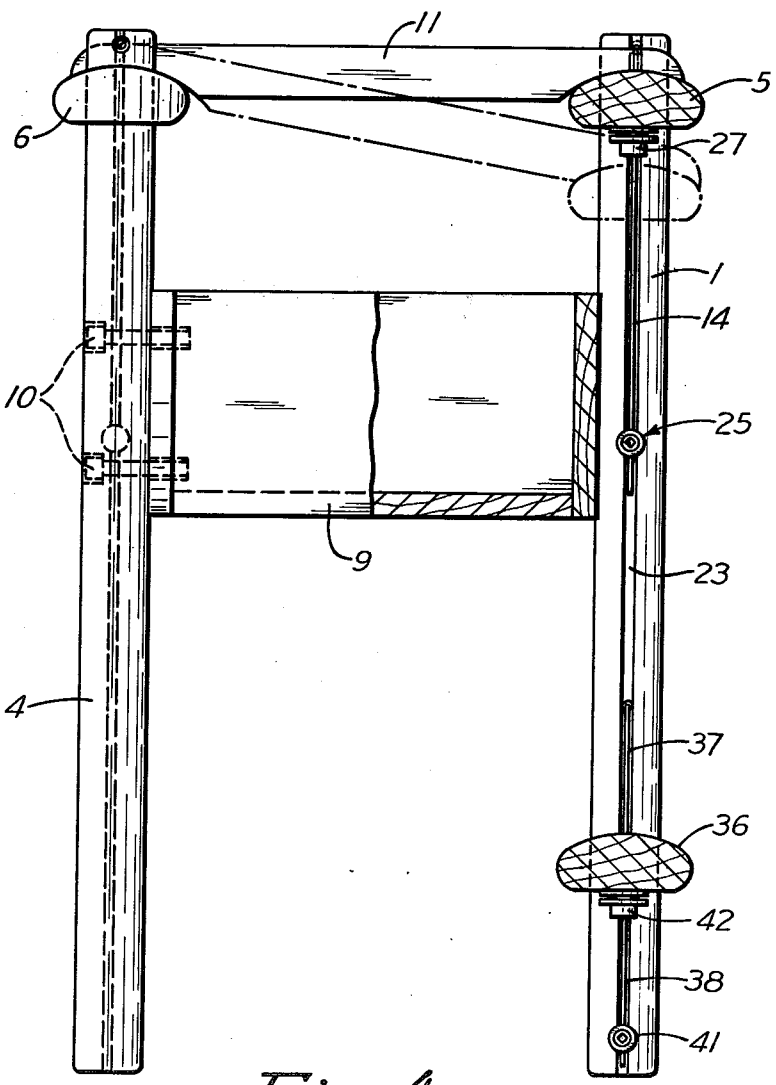
FIG. 4 is a vertical section taken on the line IV—IV of FIG. 2.

A bottom rail or footrest rail 36, made like the top rails, is slidably mounted on the lower portions of the front legs below the tray, as shown in FIGS. 1 and 4, but is supported by a pair of cables 37 and 38 in the same way as the top rails so that the footrest can be adjusted vertically as desired. The upper end of cable 37 is attached to leg 1 below the tray and extends down through the footrest rail and then lengthwise of it in engagement with its lower portion. As shown in FIG. 1, the cable passes over a cross pin 39 in the opposite end of the rail and then extends down to an anchor 40 in leg 2. The other cable extends from leg 2 across the rail in the opposite direction and has its lower end attached to leg 1 by means of an anchor 41. Normally, these two cables are locked against movement by a clamp 42 like the ones previously described. When the clamp is loosened, the footrest rail can be adjusted up or down the front legs of the bench.

The seat 11 is not attached to the rails but merely rests on them so that it can be slid lengthwise of the bench to any desired position. To prevent the seat from moving forward or backward and thus slipping off the rails, the bottom of the seat is provided with grooves 44 fitting the tops of the top rails as shown in FIG. 4. It also is desirable to have the center portion of the seat extend down between the rails in engagement with them. It sometimes is desirable to change the angle of the seat so that it will slope either forward or backward, according to the desire of the person using the bench. This can be done by raising or lowering one of the top rails relative to the other one as indicated in dotted lines in FIG. 4. To preserve substantially the same relatively large areas of contact between the seat and rails when the seat is inclined, as when it is horizontal, and thus avoid objectionable line contact that would occur if the rails were flat on top, the upper surfaces of the top rails are convex transversely of the rails, with each of the surfaces forming a segment of a cylinder. Likewise, the surface of the wall of each groove forms a segment of a cylinder. All of these surfaces have substantially the same radius so that the seat grooves fit the upper surfaces of the top rails when those rails are at the same level and also fit them when one of the rails is lower than the other one to slant the seat. The elevation of the seat, whether horizontal or slanted, can be adjusted by sliding one or both top rails up or down the bench legs after clamps 27 and 34 have been loosened to free the adjoining cables.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An adjustable wooden bench comprising a pair of front legs and a pair of back legs, a horizontal back rail connecting the upper portions of the back legs, bracing means disposed below the level of said rail and rigidly connected to all four legs to hold them in fixed position relative to one another, a horizontal front rail provided at its ends with vertical openings therethrough receiving the upper portions of said front legs and slidably mounted thereon, a pair of flexible cables anchored at one end to the front legs above the front rail, each cable extending down into the underlying vertical opening in the front rail and then lengthwise of the rail in engagement with the lower portion thereof toward the opposite end of the rail, means connected to the front rail near the front leg at said opposite end for supporting said cable, the cables extending from their respective said supporting means downwardly along the adjoining front legs, means spaced below the front rail anchoring the lower ends of the cables to the front legs, whereby when the front rail is moved up or down on the front legs the cables will maintain it horizontal while they slide along the rail, releasable means connected to the front rail and engaging said cables for normally locking them against movement lengthwise of that rail to prevent it from moving vertically, and a seat resting on said rails.

2. An adjustable wooden bench according to claim 1, in which said front legs are provided with slots extending lengthwise thereof for receiving the vertically extending portions of the cables.

3. An adjustable wooden bench according to claim 1, in which the bottom of said front rail is provided with a cablereceiving slot extending from each front leg toward the opposite end of the rail, and said cable-supporting means are cross members mounted in the front rail and extending across said slots close to the legs.

4. An adjustable wooden bench according to claim 1, in which said releasable means include a screw extending up between said cables beneath the front rail and threaded into it, and means on the screw press the cables tightly against the bottom of the rail when the screw is tightened, whereby to clamp them against the rail.

5. An adjustable wooden bench according to claim 1, in which said bracing means is a tray having a bottom and side and end walls, and fastening members extend through said legs and into the tray to rigidly connect the legs to the tray.

6. An adjustable wooden bench according to claim 1, in which said back rail is provided at its ends with vertical openings therethrough receiving the upper portions of the back legs and slidably mounted thereon, and a pair of flexible cables are connected with the back legs and back rail in the same way as the front cables are connected with the front legs and front rail, whereby the back rail can be adjusted in the same way up and down the back legs.

7. An adjustable wooden bench according to claim 1, including a horizontal footrest rail provided with vertical openings through its opposite ends receiving said front legs below said tray and slidably mounted thereon, a pair of flexible cables anchored at one end to the front legs above the footrest rail, each cable extending down into the underlying vertical opening in the footrest rail and then lengthwise of the rail in engagement with the lower portion thereof toward the opposite end of the rail, means connected to the footrest rail near the front leg at said opposite end for supporting the last-mentioned cable, the footrest-engaging cables extending from their respective said supporting means downwardly along the adjoining front legs, means spaced below the footrest rail anchoring the lower ends of the cables to the front legs, and releasable means connected to the footrest rail and engaging said last-mentioned cables for normally locking them against movement lengthwise of that rail.

8. An adjustable wooden bench according to claim 1, in which the upper surfaces of said rails are convex transversely of the rails, each of said surfaces forms a segment of a cylinder, and the bottom of said seat is provided with concave grooves receiving said convex surfaces, the wall surface of each groove forming a segment of a cylinder, all of said surfaces having substantially the same radius so that said wall surfaces can fit said upper surfaces of the rails when those rails are at the same level and also when one of them is lower than the other one to slant said seat, whereby line contact between the seat and rails can be avoided.

* * * * *